US006662382B2

(12) United States Patent
Rump et al.

(10) Patent No.: US 6,662,382 B2
(45) Date of Patent: Dec. 16, 2003

(54) DEVICE FOR AUTOMATIC RELEASE OF A FLUSHING PROCESS IN URINALS OR SIMILAR SANITARY APPLIANCES

(75) Inventors: Hanns Rump, Hausen (DE); Rainer Kotte, Elsenfeld (DE)

(73) Assignee: Rosemarie Brand-Gerhart, Hausen (DE)

( * ) Notice: Subject to any disclaimer, the term of this patent is extended or adjusted under 35 U.S.C. 154(b) by 0 days.

(21) Appl. No.: 09/542,065

(22) Filed: Apr. 3, 2000

(65) Prior Publication Data

US 2002/0053104 A1 May 9, 2002

Related U.S. Application Data

(63) Continuation-in-part of application No. PCT/DE98/02923, filed on Oct. 1, 1998.

(51) Int. Cl.[7] ..... E03D 13/00

(52) U.S. Cl. ..... 4/304; 4/305; 4/DIG. 3

(58) Field of Search ..... 4/302, DIG. 3, 4/304, 305, 313

(56) References Cited

U.S. PATENT DOCUMENTS 669,037 A * 2/1901 Stevens ..... 4/DIG. 3
1,201,711 A * 10/1916 Finney ..... 4/302
5,246,045 A * 9/1993 Clothier et al. ..... 141/95

* cited by examiner

*Primary Examiner*—Robert M. Fetsuga
(74) *Attorney, Agent, or Firm*—Horst Kasper

(57) ABSTRACT

The invention relates to a device for the automatic release of a flushing process after use of a urinal or similar sanitary appliance. The invention is characterized in that at least one sensor is placed in the trap. When the level of the liquid in the trap changes, the sensor generates a switching impulse which controls a water electrovalve. This causes the water valve to open and flushing to begin

23 Claims, 6 Drawing Sheets

DEVICE FOR AUTOMATIC RELEASE OF A FLUSHING PROCESS IN URINALS OR SIMILAR SANITARY APPLIANCES

CROSS-REFERENCE TO RELATED APPLICATIONS

This application is a continuation-in-part application of another international application filed under the Patent Cooperation treaty Oct. 1, 1998, bearing Application No. PCT/DE98/02923, and listing the United States as a designated and/or elected country. The entire disclosure of this latter application, including the drawings thereof, is hereby incorporated in this application as if fully set forth herein.

BACKGROUND OF THE INVENTION

1. Field of the Invention

The present invention relates to a device for the automatic release of a flushing process in urinals or, respectively, similar sanitary engineering installations, such as toilets, after their use.

The invention relates to a device for automatic release of a flushing process after using of a urinal or similar sanitary technological installations, such as toilets, wherein at least one target is disposed in a stink trap (siphon) exhibiting an inlet and an outlet, wherein the target changes its position in case of level changes of the liquid contained in the siphon and wherein the position change is captured by a sensor, wherein the sensor causes the generation of a switching pulse then, when the liquid level changes by a predetermined amount, and wherein the switching pulse triggers an electro-water valve or, respectively, magnet controlled water valve, whereby the opening of the water valve and the initiation of the flushing process is caused.

2. Brief Description of the Background of the Invention Including Prior Art

It is desirable for reasons of hygiene to flush urinals automatically and contact free after their use. Numerous embodiments are known for this purpose, wherein the use is recognized and the flushing activated by an evaluation electronics through an electromagnetic water valve.

The conventional principles of sensors for the purpose of releasing of flushing processes in urinals are predominantly based on the recognition of a user. Devices with the passive infrared sensors are known, which detect the thermal radiation of human beings in front of the urinal and thereby release the flushing. Furthermore devices with active infrared sensors are known, which emit an infrared signal, which is reflected by the human being in front of the urinal. The reflection signal provides indirectly information if a usage has taken place. Finally, devices with radar sensors are known, which devices emit microwaves, wherein the microwaves are reflected by the human being in front of the urinal.

Devices with thermal sensors are based on the detection of changes of the liquid contained in the urinal upon use. These devices are incorporated in the stink trap and detect the temperature change upon urine feeding into the water of the stink trap.

It is common to all methods that the permanent operation of the sensors and the permanent operations of the electronic use up electrical energy, which is furnished in general by a battery. The lifetime of the battery is limited by the continuous, even though small flow of current, which requires expensive service interventions for purposes of exchanging the battery.

Based on the relative frequent change of batteries, the change of batteries has to be performable without a large technical expenditure, which forces to place the battery at an accessible location.

Urinals are frequently installed in picnic areas or other public installations. The problem of vandalism exists here, and for this reason as little operating parts or equipment parts as possible should be visible from the outside of the urinal or, respectively, be present as separate construction elements. In an ideal situation the device for controlling the flushing is therefore completely incorporated into the urinal and in this respect completely integrated and is from the outside neither visible nor accessible. This requirement can however only be fulfilled, if the energy use of urinal is so low that without further actions a reliable operation of 5 to 10 years can be assured with a single battery.

A device for automatic releasing of a flushing process after using of a urinal has become known through the Japanese printed patent document JP-A-07 1893 15, wherein a float switch or target is disposed in a siphon of the urinal, wherein the float switch changes its position upon level changes of the liquid contained in the siphon and generates thereby a switching pulse, with which switching pulse a magnet controlled water valve is triggered, whereby the opening of the magnet controlled water valve is caused and the initiation of the flushing process is caused.

A urinal with stink trap and an automatic flushing device has become known from the German printed patent document DE-A-2445223, wherein the flushing device comprises an electronic control unit, wherein the electronic control unit triggers a magnet valve disposed in the water inlet and exhibits a pulse generator exciting the control unit. A measurement sensor is disposed between the level of the overflow edge of the stink trap and the liquid level disposed lower after each flushing, wherein the measurement sensor conducts a switching signal to an electronic control unit upon the flushing of liquid.

SUMMARY OF THE INVENTION

1. Purposes of the Invention

It is therefore an object of the invention to furnish a device for the automatic release of a flushing process in urinals or, respectively, similar sanitary engineering installations after their use under avoiding of these recited disadvantages, wherein the device for automatic release is completely integrated into the installations and exhibits a small maintenance expenditure.

These and other objects and advantages of the present invention will become evident from the description which follows.

2. Brief Description of the Invention

The present invention provides a device for the automatic release of a flushing process after using of a urinal or a similar sanitary engineering installation, such as toilet according to the initially recited kind, wherein according to the invention a discharge barrier is disposed in the outset of the siphon, wherein the discharge barrier is furnished with an opening, wherein the cross-section of this opening is dimensioned such that only a volume stream smaller than the average amount of urine delivered per time unit is possible, and wherein the target is disposed in the region in front of the discharge barrier.

The sensor is here an active sensor, for example a proximity switch, or preferably a passive element for reasons of energy savings, in particular an electrical or mechanical contact, wherein the electrical or mechanical contact is closed or actuated upon level changes.

The sensor initiates a flushing processes then, when the liquid level changes by a predetermined amount. The liquid level can increase based on a use according to the purposes or can be lowered by a long nonuse. In both cases, but at least during the increase of the level, the flushing is activated.

The apparatus comprises a target, in particular a float or an element attached to a float, which changes its position upon level changes of the liquid contained in the siphon. The changing position of the target is captured by the sensor and causes the generation of a switching pulse.

In order to amplify the increase of the liquid level with external feed of liquid, a discharge barrier is disposed in the discharge outlet of the siphon according to the present invention. This discharge barrier is furnished with an opening or, respectively, the discharge barrier together with the internal wall of the siphon forms an opening. The cross-section of this opening is dimensioned such that the opening allows only a volume stream, wherein the volume stream is smaller than the average amount of urine per time unit. Therefore the level upon external liquid feed increases in the space formed by the barrier and the inner wall of the siphon, which is detected by the sensor according to the present invention. The opening is here disposed preferably below the level of the discharge barrier and enables the discharge of the water to the level of the discharge channel.

An energy-saving detection principle provides that the sensor includes a float, wherein at least one magnet is disposed at the float, as well as a magnet contact. Here the float is disposed movably in the region in front of the discharge barrier. The magnet contact is fixed in position. The position of the float can be determined through the magnet contact.

The magnet contacts closed by a magnet through the deflection of the float from the standard level preferably switch a current circuit, wherein the current circuit activates an electronic control and automatic control unit for predetermined time period, which control and automatic control unit initiates the flushing of the urinal according to a predetermined cause of action plan.

According to a further preferred embodiment the float carries a hollow body, which exhibits a discharge opening of a small cross-section, wherein the hollow body is disposed such in the siphon, that the hollow body is filled by the fed-in urine, which entails a change in position of the float, wherein the change of the position of the float triggers a switching pulse.

The internal of the urinal is constructed such, according to a further preferred embodiment, that a further hollow body is disposed in front of the barrier in the drain trap adapted to the level next to the drain trap. This further hollow body is connected to the drain trap by flow engineering such, that this connection allows liquid to flow into the hollow body, which liquid is introduced below the discharge barrier of the drain trap, wherein the hollow body is connected to the discharge outlet of the stink trap by a discharge direction in the lower region.

Preferably, then the sensor and a float are disposed in this second hollow body. The float is movable and exhibits a target, in particular a magnet. The target and the float can also be identical. The spatially fixed disposed sensor is in particular a magnet switch. The sensor causes the generation of a switching pulse upon approach of the target by the floating of the float, wherein the switching pulse triggers a flushing process. Upon floating of the float for example the magnet triggers a magnet switch.

According to a further preferred embodiment of the invention, the switching pulse of the sensor is an electronic pulse, wherein the electronic pulse activates a control circuit, wherein the control circuit generates a signal for triggering of the flushing process and wherein the control circuit automatically deactivates after passage of a predetermined time period after activation. A particular current saving automatic flushing is thereby accomplished.

The control circuit preferably comprises a time delay member, in particular a flip-flop, wherein the flip-flop generates the contact of a control unit, in particular of a microprocessor, to a current or, respectively, voltage source upon triggering with the switching pulse of the sensor for a predetermined time period. The control unit is thereby activated and is capable to trigger the release of the flushing process. The current or, respectively, voltage source is decoupled from the control circuit in the last position such that no discharge occurs. The current or, respectively voltage source is charged and loaded for a short time only for the duration of the triggering of the flushing.

A device dispenses completely of electrical energy, wherein the sensor comprises a float, wherein the float changes its position after feeding in of a liquid and therewith triggers a mechanical hydraulic actuated valve mechanism and control mechanism, which leads to the release of the flushing process.

The sensor can comprise a pair of electrodes (10.1, 10.2) as an alternative to the construction with a float, wherein the pair of electrodes comprises a change of the liquid level and/or of the composition of the liquid by detection of a change of the liquid properties in fornt of the barrier, which is capable to detect a change of the liquid level. Finally, the sensor can be a capacitive sensor (12.1, 12.2) or an inductive sensor (13.1) for detection of a change of the liquid level.

The sensor comprises a light detector, which light detector is capable to detect a change of the level of the liquid. Alternatively, the sensor can be a capacitive sensor or an inductive sensor for detection of the level of liquid.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

In the accompanying drawing, in which are shown several of the various possible embodiments of the present invention.

DESCRIPTION OF INVENTION AND PREFERRED EMBODIMENT

Figure 1:
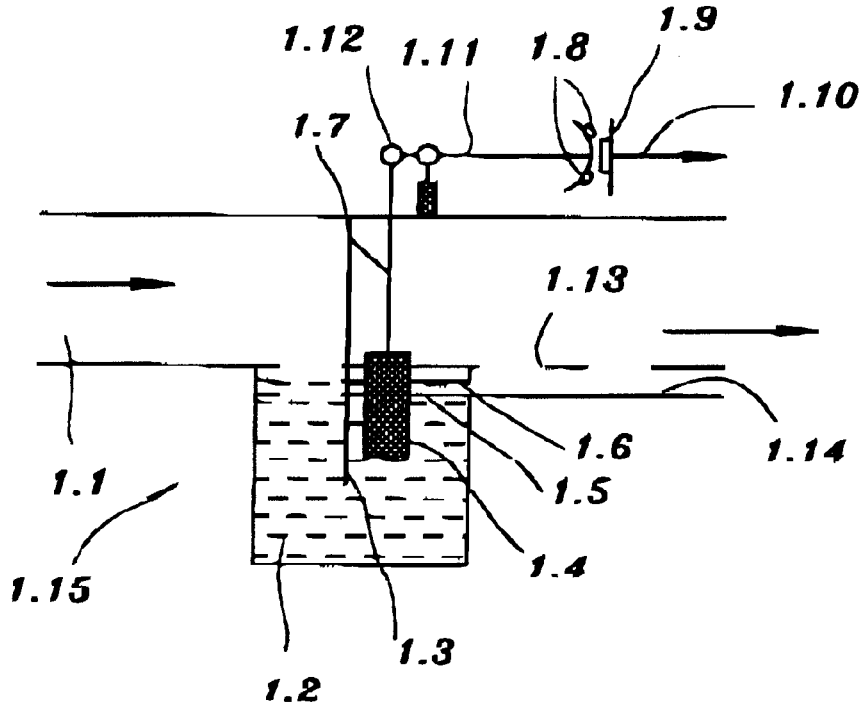
FIG. 1 is a view of schematic diagram of an example of a device for automatic triggering of a flushing process in the stink trap of a urinal.

The trigger mechanism according to the present invention is the component of a stink trap 1.15 of a urinal and is illustrated in FIG. 1. The stink trap 1.15 exhibits a feed inlet 1.1 and a discharge outlet 1.14 disposed at a lower level relative to the feed inlet 1.1. The feed inlet 1.1 and the discharge outlet 1.14 are separated by the water reservoir 1.2 and by a trap barrier 1.3 immersed in the water reservoir 1.2 in such a way that no air exchange is possible between the region of the feed inlet and the discharge outlet, but a flow through of liquid is possible.

A target is in general disposed in the water trap of the urinal exhibiting a feed-in inlet 1.1 and a discharge outlet 1.14, wherein the target changes its position upon level changes of the liquid contained in the water trap. More particularly, the target is a float 1.4 disposed in the discharge side part of the water trap 1.15, wherein the float 1.4 changes its vertical position in case liquid is fed into the urinal or if liquid evaporates in the water trap. The position of the float 1.4 is captured by suitable sensors, wherein the sensors are magnets/magnet contacts 1.8,1.9 in this example, which magnets/magnet contacts actuate a switch or, respectively, operate as a switch. If the float 1.4 changes its vertical position by a predetermined amount, then a flushing is triggered and an electro-water valve or, respectively, magnet valve is opened.

Figure 4:
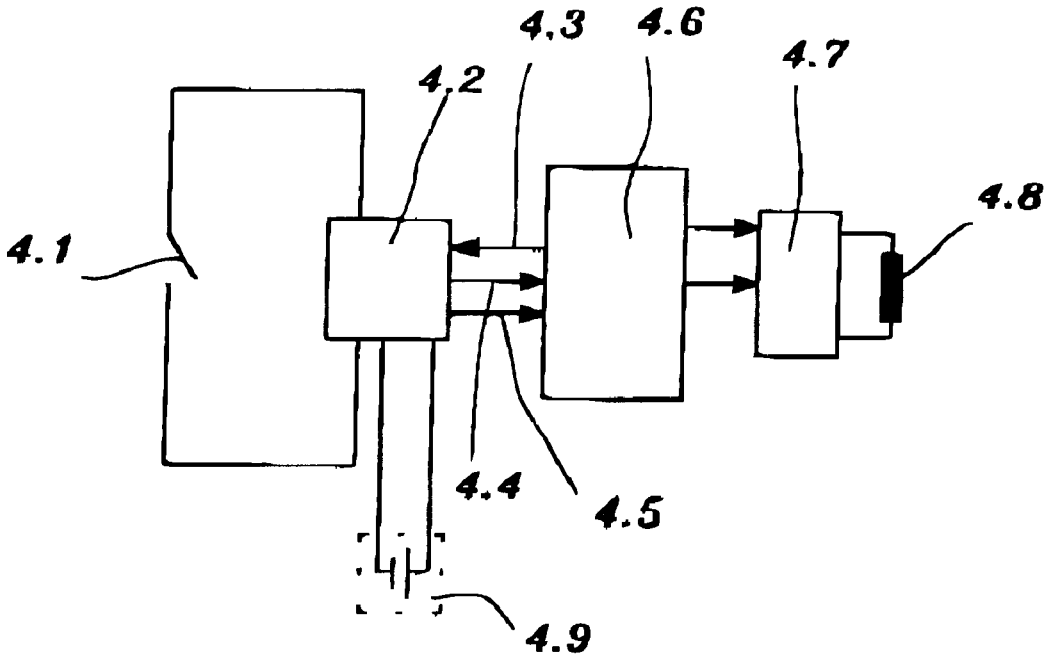
FIG. 4 is a view of a schematic block circuit diagram of a control circuit for triggering of a flushing process, FIG. 5 a view of a plotting of the time course of the control of the flushing process, FIG. 6 a view of a schematic diagram showing an example for an embodiment of a float.

The position of the float 1.4 is preferably scanned by magnet contacts 1.9, wherein the magnet contacts 1.9 are triggered by the magnets 1.8, which magnets 1.8 are connected to the float 1.4 through a lever rod construction 1.7, 1.11 and which magnets are furnished as a tiltable double magnet arrangement. Either the one magnet 1.8 or the other magnet 1.8 pivots past the contact 1.9 for triggering a switching process of an electrical contact 1.9 disposed opposite to the magnets 1.8, which corresponds to two different levels of the float 1.4. A switching pulse is triggered by the magnet contact 1.9 through a conduit 1.10, wherein the switching pulse is received by a control circuit. The electronic circuit according to FIG. 4 is constructed such that a complete switching off of the electronics without quiescent current is performed between the flushings.

The feeding in of liquid into the urinal and the therewith associated changes of the level of a liquid level for gaining of a switching pulse is employed according to the present invention and in contrast to conventional solutions. The fact of the level change is increased by the introduction of a discharge barrier 1.6 (Venturi-channel) into the discharge side part of the stink trap, wherein the discharge barrier 1.6 generates a discharge of decreased cross-section, Venturi effect.

The level of the water reservoir 1.2 is disposed at the level 1.5 of the discharge outlet 1.14 or below in rest position without external feeding in of liquid. The float 1.4 assumes a position corresponding to the level 1.5. The magnets 1.8 are held in a defined position relative to the contact 1.9 mediated by lever rods 1.7,1.11, wherein the lever rods 1.7,1.11 are coupled by a hinge 1.12. The level rises maximally to the level 1.13 in case of an external liquid feed-in, wherein the level 1.13 is defined by the upper edge of the discharge barrier 1.6. The magnet contact is triggered by the joint motion of the float 1.4 and the switching pulse is generated. The additional liquid can flow off again slowly through the opening, for example a hole or a slot in the barrier, such that a new switching process can be performed.

Figure 2:
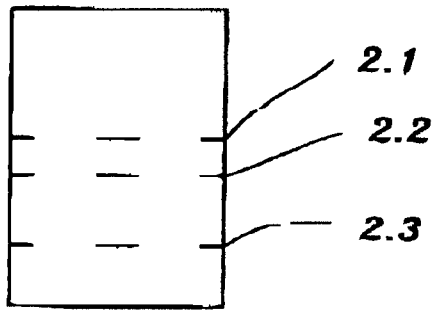
FIG. 2 is a view of a schematic diagram illustrating the filling level height of the water reservoir in the stink trap.

A water level 2.1 results upon initial operation of the urinal in the water trap according to figure 2. After short time, the water flows off through a hole or, respectively, a diaphragm in the barrier 1.6 according to figure 1 such that the water level 2.2 results as shown in FIG. 2.

The diaphragm in the barrier 1.6 is dimensioned such that the water level rises to the level 2.1 upon a feed-in of urine in a usual amount per time unit, because the diaphragm allows a smaller flow through amount to flow off as the amount which is fed in by the usage.

In general a throttling means is provided which throttle the flow of liquid from one side of the barrier to the discharge side of the barrier when liquid is added to a quiescent state of the urinal. The throttling means can have different construction. The throttling means is laid out such that only a fraction of the average amount of liquid added according to experience will flow from the first side of the discharge barrier to the discharge side of the barrier when stating from a quiescent state of the urinal. Preferably such fraction flowing of is per time unit one third to one fifth of the amount of liquid added per time unit. One can assume for example that an average amount of from about 50 cubic centimeters to 200 cubic centimeters in urine is placed into a urinal used by a person. In such case the amount of discharge would preferably range from about 10 cubic centimeters per minute to 50 cubic centimeters per minute and more preferably to from about 20 cubic centimeters per minute to 40 cubic centimeters per minute. Thus the feed-in occurs immediately like a stroke, while the discharge takes time. Calculating that the flow off volume is only from about one third to one fifth of the flow-in volume, one can roughly expect that the time of discharge will last from about 3 times the feed-in time to 6 times the feed-in time assuming a uniform feed-in volume over the time period of feeding-in, such that in a simplified way a general discharge time around 4 times the feed-in time period can be assumed.

The construction of the throttling means can be performed in various ways. Preferably the throttling occurs in such way that for a constant feed-in volume per time unit also a substantially constant discharge volume is provided per time unit. Such construction would in general lead to the expectation that the liquid level in front of the discharge barrier would rise at a constant speed thereby providing a also a substantially uniform speed to the float when floating up upon usage of the urinal.

The most simple shape of the throttling means is a cylindrical hole in the wall of the discharge barrier. The amount of liquid passing through such hole can be calculated by the laws of fluid dynamics and it is approximately proportional to the square of the diameter of the hole and inversely proportional to the length or depth of a cylindrical hole. However the throttling means is not limited to a hole and can have also other cross-sections like that of an ellipse, of a square of a rectangle or of a slot. The throttling means can also be a recess generated either in a bottom side of a discharge barrier board or a recess in the upper edge of the discharge barrier. A recess in the upper edge of the discharge barrier can be formed such that the bottom of the recess has a larger width as compared to the top point of the recess. The flow-off speed through the throttling means can be controlled by the shape of the recess relative to the speed and volume of the fed-in urine or liquid.

Figure 3:
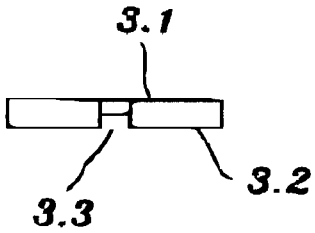
FIG. 3 is a view of a schematic diagram of a discharge barrier in the discharge outlet of a stink barrier.

FIG. 3 shows schematically such a barrier, wherein the barrier of course can be furnished in a number of varieties. The upper edge of the diaphragm represents an overflow 3.1, wherein the larger amount of liquid can freely flow off the upper edge of the diaphragm. If no further feeding in occurs, then the liquid flows off through an opening 3.3, such as a slot or a recess or a hole in the region of the lower edge 3.2, such that after sometime the liquid level corresponds to the lower edge 3.2 of the barrier. The opening 3.3 is dimensioned such that it allows such water amount to pass, which water amount is smaller as the average feed in amount upon usage of the urinal.

The feed in of liquid in a larger amount as the amount flowing off through the diaphragm leads to the situation that the float 1.4 in FIG. 1 floats upwardly and actuates a lever 1.11 through an actuation rod 1.7, such that one of the permanent magnets 1.8 passes into the neighborhood of the electrical contact 1.9, wherein the electrical contact 1.9 is closed under the influence of the magnetic field and delivers a pulse, a switching pulse, to a conduit 1.10 derived from the contact. This switching pulse is communicated to an electrical circuit, wherein the electrical circuit is in principle explained in FIG. 4.

The circuit shown in FIG. 4 comprises the following principal components: an electrical contact 4.1 which is closed by a switching pulse; a time member 4.2 with an electrical on-switch, which activates the electronic device group 4.6, 4.7 for a predetermined time period; electrical conduits 4.3, 4.4, 4.5 for signal transfer to the electronic device group 4.6, 4.7; an electrical course control 4.6, for example a microprocessor; an electronic switching bridge 4.7 for controlling an electro-valve 4.8 as well as the current or, respectively, voltage source 4.9, which is preferably an electric battery of long lifetime duration, for example a lithium battery.

The circuit switches off automatically in the rest position, wherein for example a circuit 4.2 formed as a flip-flop flips into a state, which for example thereby blocks a transistor feeding in the voltage.

The course in case of a usage is as follows: If the contact 4.1 is closed, for example the electrical time delay member 4.2 switched as a flip-flop is fed with voltage and flips in a state, which opens the transistor feeding in the voltage for a short time period. The microprocessor 4.6 is thereby placed in operation wherein the microprocessor 4.6 also opens the transistor feeding in the voltage according to a program, as long as the microprocessor operates.

After an appropriate waiting time, for example 5 to 20 seconds, the microprocessor 4.6 triggers a flushing by feeding a switching pulse "valve equal open" through a driver circuit 4.7 to the magnet valve 4.8, wherein the magnet valve 4.8 opens the water valve. After performed flushing time, a closure pulse is released in the same manner, wherein the closing pulse again closes the magnet valve 4.8 and the thereto connected water valve.

In the following again a waiting time occurs, during which the position of the switch is not any longer observed in order to quiet down the float move by the flowing flushing water and in order to lower the water level to the required lower level.

The microprocessor 4.6 switches the flip-flop 4.2 and the thereby switching transistor back to current supply after passage of this waiting time and renders the circuit again free from current. The possibility is present in the following again that a new switching pulse triggers a renewed flushing.

Figure 5:
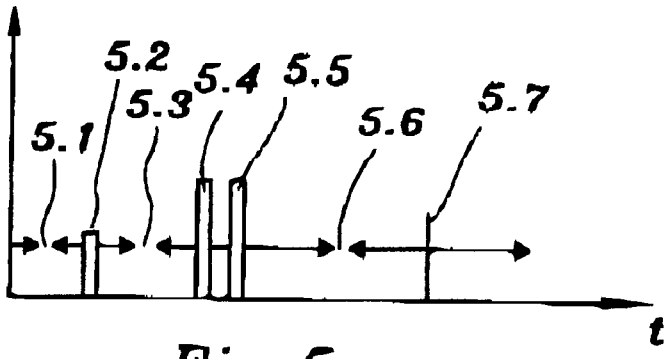

The time sequence course of a program sequence is illustrated in FIG. 5 on the time axis t. The following meaning is associated with the reference characters:

5.1 reaction time after feeding in of liquid
5.2 response of the control contact excited by the float and taking into operation of the electronics and starting of the program
5.3 waiting time
5.4 triggering of the flushing
5.5 stoppage of the flushing
5.6 waiting time
5.7 switching off of the system and thereby renewed sharpening for the next usage.

The invention provides that the flushing occurs upon floating of the float 1.4, which occurs upon feeding in of urine or other liquids into the urinal, wherein in this case one of the two magnets 1.8 triggers the switching contact 1.9 through the actuating rod 1.7 and the lever 1.11.

However, a flushing is also then triggered when the level falls below a certain limit within the water trap because the moving down of the float moves in this case the other one of the magnets 1.8 of the double magnet arrangement into the switching position. It is thereby advantageously made sure that the urinal will not dry out in case of a longer nonuse. In addition after the connection of the water pressure, a first flushing is triggered thereby in case of a first use of the urinal.

The stroke of the float 1.4 as a consequence of the feeding in of liquid is supported by having the level of the inlet 1.13 and of the discharge outlet 1.14 not completely identical, but having the discharge outlet 1.14 disposed lower and by having a barrier 1.6 disposed in front of the discharge outlet 1.14.

Figure 6:
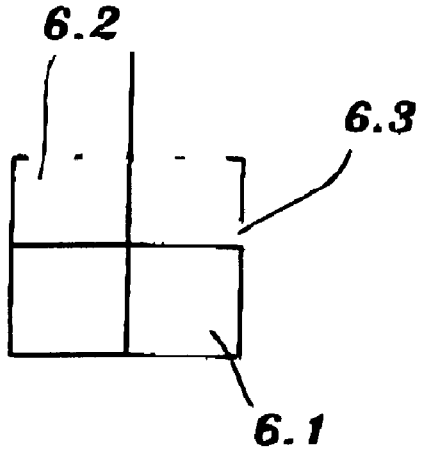

According to another embodiment of the invention it is disclosed to construct a float 6.1 according to FIG. 6 such that the float 6.1 carries a vessel 6.2, which vessel is furnished with a discharge outlet 6.3 having a small cross-section and disposed at the vessel floor. If liquid, for example urine, has flowed into the vessel 6.2, then the liquid can leave the vessel 6.2 after some time through this discharge outlet 6.3. If the vessel 6.2 is filled with liquid, then the float 6.1 sinks deeper into the water in the siphon.

Figure 7:
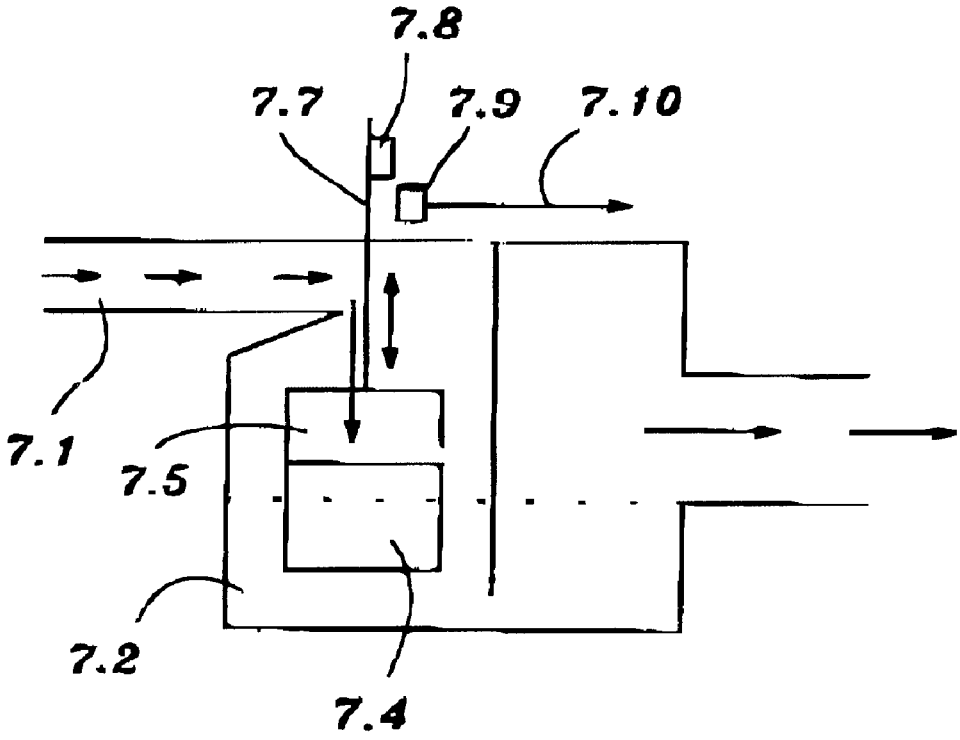
FIG. 7 is a view of a further example for devices for automatic triggering of a flushing process in the drain trap of a urinal.

The arrangement as such is illustrated in FIG. 7, wherein FIG. 7 similarly as shown in FIG. 6, shows the float in the water trap and an indicated electrical contact provider. The change in position is detected in the sense of the above recited description and is employed for generating a flushing process.

The float 7.4 is disposed according to this example in the feed line side front part 7.1 of the siphon such that the vessel 7.5 is filled upon use of the urinal, the vessel 7.5 thereby sinks deeper into the water reservoir 7.2, which is noted by the sensors and which releases a flushing process. The float 7.4 moves a target 7.8 through a lever rod 7.7, wherein the position change of the target 7.8 is captured by a sensor 7.9 and triggers a switching pulse. This switching pulse is transferred through the conduit 7.10 to the control circuit.

Figure 8:
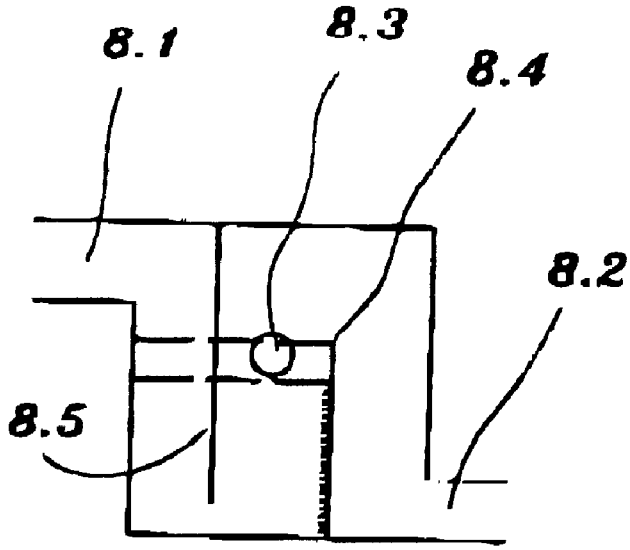
FIG. 8 is a view of another example for devices for automatic triggering of a flushing process in the drain trap of a urinal.
Figure 9:
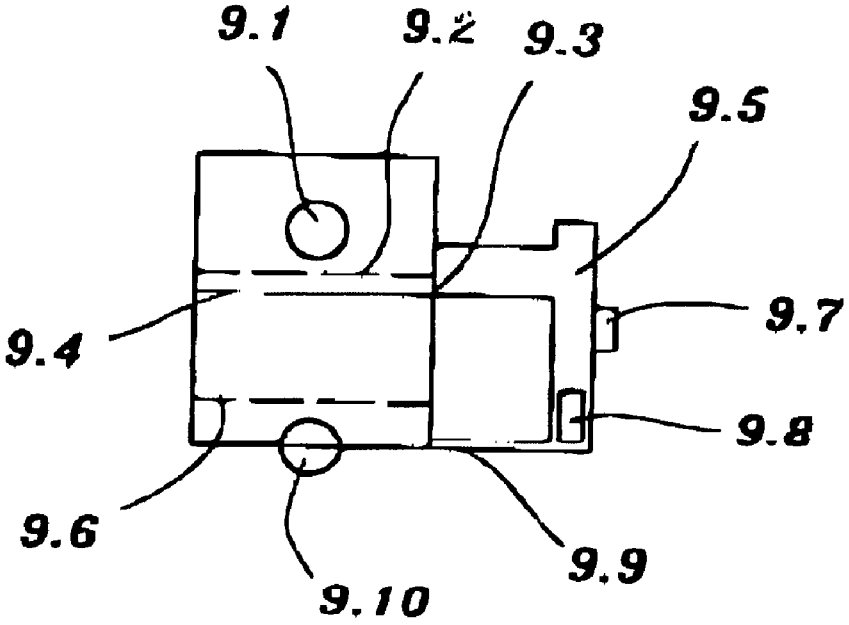
FIG. 9 is a side elevational view of a device according to FIG. 8.
Figure 10:
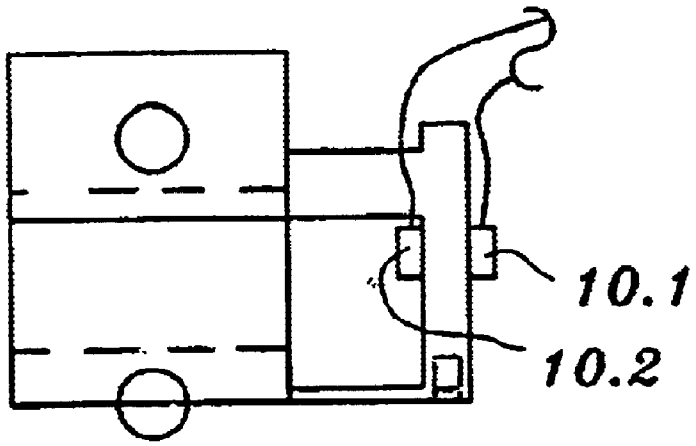
FIG. 10 is a schematic view of pair of electrodes.
Figure 11:
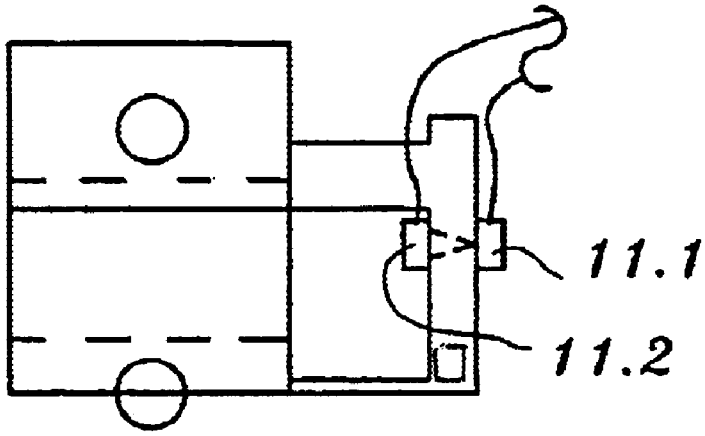
FIG. 11 is a schematic view of light detector.
Figure 13:
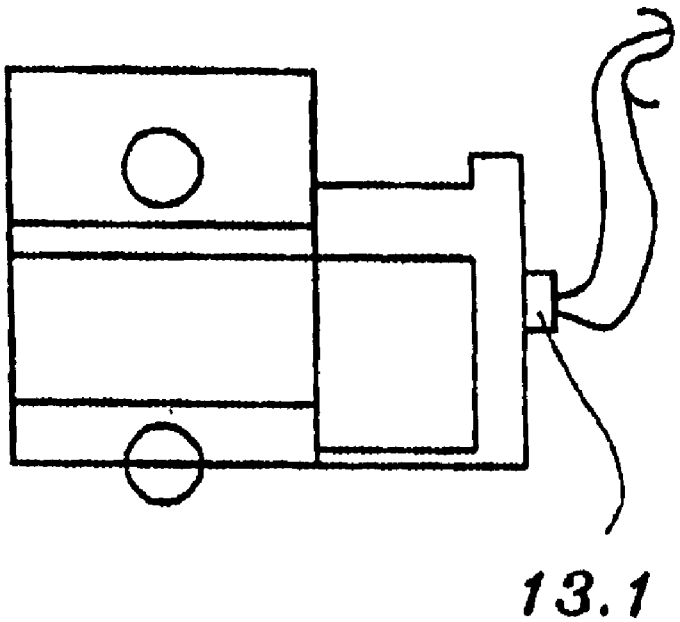
FIG. 13 is a schematic view of inductive sensor.
Figure 12:
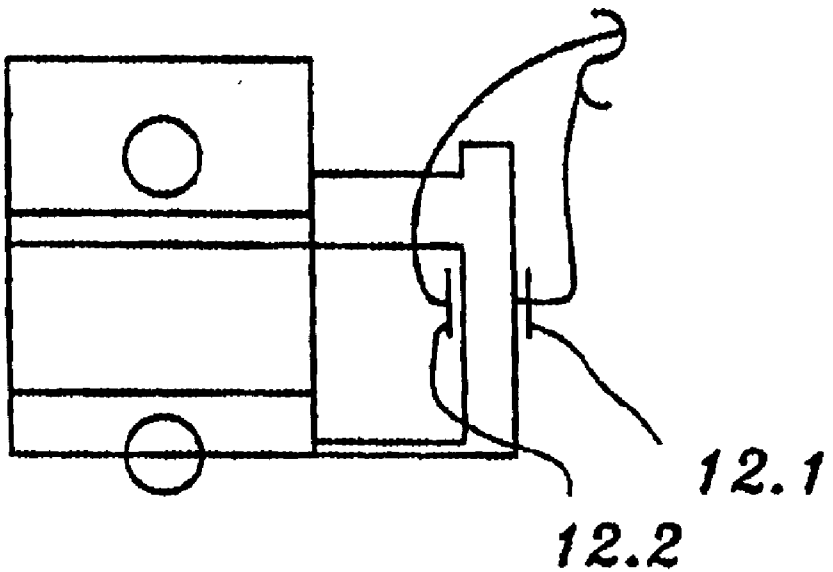
FIG. 12 is a schematic view of capacitive sensor.

A further embodiment example of the invention is described in the FIGS. 8 and 9. FIG. 8 shows again a water trap of a urinal or the like in cross-section. FIG. 9 shows the same water trap in a side elevational view. The feed in inlet 8.1 or, respectively 9.1 is disposed at a higher level as the discharge outlet 8.2 or, respectively, 9.10. The air space of the feed-in inlet and discharge outlet are separated by [two barriers 8.4 and] a trap barrier 8.5 and a discharge side barrier 8.4 and by dammed up and banked up water between the feed-in side part of the siphon and the discharge side barrier 8.4. The opening to one overflow tube 8.3 or, respectively, 9.3 is disposed somewhat below the upper edge of the discharge side barrier 8.4, wherein the opening joins into a vessel 9.5 of smaller volume, preferably of cylindrical shape. A float 9.8 is disposed in this vessel 9.5. Liquid fed into the urinal and thus into the discharge side part of the water reservoir will therefore first flow through the tube 9.3 into the float cylinder 9.5. This liquid can flow back through a further tube 9.9 of smaller cross-section into the discharge outlet 9.10 of the siphon and in this way can empty the float cylinder 9.5. The liquid levels occurring in the various stages are designated with 9.2, 9.4 and 9.6. If a feed-in occurs in an amount surpassing discharge speed, then the liquid level in the float cylinder 9.5 rises and the float 9.8 floats upwardly. The float 9.8 carries a permanent magnet or another target, which for example is captured by a proximity sensor. Upon approach to the sensor 9.7, which is in this case a magnet switch, the sensor triggers indirectly through the electronics a flushing process through a magnet valve. Based on the volume differences between the float cylinder and the volume of the liquid within the siphon this construction operates like a hydraulic lever, because therewith also smaller feed-ins of liquid or, respectively, urine can release a substantial and easily evaluable stroke of the float.

The electronic circuit and the program course of the electronic circuit can be performed in different ways. A microprocessor is advantageous, however not necessarily required.

The disposition of the float or, respectively of the level scanning within the discharge outlet disposed in the siphon can be performed in a variety of ways.

According to the teaching of the present invention there is always in common that the trigger of the flushing occurs depending on the level of liquid, for example by scanning the position of a float or, respectively, of the water level and triggering a flushing process upon a deflection from the standard position. This can for example also be performed by having a magnet attached to a float to induce a voltage in a correspondingly disposed coil upon motion of the float, wherein the voltage is employed as a switching pulse.

It is always advantageous to employ a so-called "Venturi diaphragm" "Venturi channel" or "Venturi-groove", wherein the volume of the water flowing passed a barrier through the diaphragm is smaller as the volume to be expected to be fed-in in the case of a usage of the urinal with the result, that in case of a feed-in of liquid, then the liquid level will rise to the level of the barrier.

A further possibility comprises to dispense with a float and to dispose two electrodes in the switch position instead of the contact 9.7 shown in FIG. 9. Since the triggering of the switching occurs in general by water comprising urine, which is electrically conducting, the urine caused change of the conductivity is employed for triggering a switching pulse. This variation is usable in all precedingly described embodiment examples.

The electronic control circuit is advantageously switched completely free of current after performing a flushing. Thereby a discharge of the battery is performed only by self discharge. A lithium battery with a capacity of about 3 ampere hours furnishes in this mode of operation a life time of about more than 10 years, such that no particular maintenance has to be provided. The power requirement necessary based on flushing allows to expect from about 500,000 to 1.2 million flushings in case of a battery capacity of three ampere hours, which would hardly occur within 10 years even in case of a highly frequented urinal installation.

According to further variation it is disclosed according to the present invention to completely dispense with an electronic control. Instead the float moved by the feed-in of liquid will actuate a mechanical/hydraulic valve and control unit, wherein the valve and control unit takes care of a flushing after a short delay. A water pressure activated servo mechanism is initiated by the float, wherein the servo mechanism in so far is responsible for the time course of the functioning and is returned into the waiting state (valve equal closed) after performed actuation. This embodiment has in common with the electronic variant that the release is performed by a float in the sense of the precedingly illustrated invention.

The unit comprising an electrical bistable valve, a battery, an electronic unit, a water distribution and a transducer disposed in the siphon are located invisibly behind the urinal and the unit is therefore effectively removed from the sense of destruction of third persons.

Commercial Utilization

The invention can in particular be advantageously and commercially applied by the operators of urinal installations. The usefulness of the invention comprises in particular that the sensor causes a flushing process then when the liquid level changes by predetermined amount. Based on the extremely energy-saving detection principle, the battery of the installation does not have to be exchanged over a course of many years.

It will be understood that each of the elements described above, or two or more together, may also find a useful application in other types of urinal system configurations and flushing procedures differing from the types described above.

While the invention has been illustrated and described as embodied in the context of a device for the automatic release of a flushing process in urinals or similar sanitary appliance, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. An apparatus for automatic triggering of a flushing process after usage of a urinal or similar sanitary engineering installation comprising a urinal;

a water trap disposed in the urinal;

a target disposed in the water trap of the urinal exhibiting a feed-in inlet and a discharge outlet, wherein the target changes its position upon level changes of the liquid contained in the water trap and wherein the target is disposed on a discharge side of the water trap;

a sensor disposed in the water trap for capturing a change in position of the target, wherein the sensor causes the generation of a switching pulse when the liquid level changes by a predetermined amount;

a water valve connected to the sensor, wherein the switching pulse triggers the water valve, thereby the opening of the water valve and initiating a flushing process;

a discharge barrier disposed in the discharge outlet of the water trap, wherein the discharge barrier is furnished with an opening, wherein the cross-section of this opening is dimensioned such that only a volume stream smaller than the average urine volume per time unit is possible to pass through this opening and wherein the target is disposed in the region of the discharge barrier;

a barrier immersed in the water trap in such a way that no air exchange is possible between the region of the feed-in inlet and the discharge outlet, but a flow through of liquid is possible.

2. The apparatus according to claim 1, wherein the opening is disposed below the level of the discharge barrier and wherein the opening enables the discharge of the water to the level of the discharge outlet.

3. The apparatus according to claim 1, wherein the target is a float, wherein a magnet is disposed at the float and wherein the sensor comprises a magnet contact, wherein the magnet contact closes upon approach of the magnet.

4. The apparatus according to claim 3, wherein the magnet contact switches a current circuit upon closing by the magnet after deflection of the float from the standard level, wherein the current circuit activates an electronic control unit and automatic control unit for a predetermined time period, which electronic control and automatic control unit induces the flushing of the urinal according to a predetermined operating course plan.

5. The apparatus according to claim 3, further comprising a hollow body, wherein the float supports the hollow body, wherein the hollow body exhibits a discharge opening of a small cross-section, wherein the hollow body is disposed such in the siphon, that the hollow body is filled with the fed-in urine, which causes a change in position of the float, whereby a switching pulse is triggered.

6. The apparatus according to claim 5, further comprising a second hollow body disposed in front of the barrier in the water trap and level adapted next to the water trap connected such that this connection allows to flow in fed-in liquid into the hollow body below the discharge barrier of the water trap, and wherein the hollow body is connected in the lower region by a discharge direction member of the discharge outlet of the water trap.

7. The apparatus according to claim 6, wherein the float with a target is movably disposed in the second hollow body and wherein the sensor is disposed spatially fixed, wherein the sensor causes the generation of a switching pulse upon approach of the target by floating of the float, which switching pulse triggers a flushing process.

8. The apparatus according to claim 1, wherein the sensor comprises a pair of electrodes which captures a change of the level of the liquid and/or the composition of the liquid by detection of a change in the conductivity.

9. The apparatus according to claim 1, wherein the sensor comprises a light barrier, which light barrier is capable to detect a change of the level of the liquid or wherein the sensor is a capacitive sensor or an inductive sensor for detection of the level of liquid.

10. The apparatus according to claim 1, wherein the sensor comprises a float, which float changes its position after feeding in of liquid and which float thereby triggers a mechanical/hydraulic actuated valve and control mechanism, which valve and control mechanism leads to a release of the flushing process.

11. The apparatus according to claim 1, wherein the switching pulse of the sensor is an electronic pulse, which electronic pulse activates a control circuit, further comprising a control circuit generating a signal for triggering the flushing process and wherein the control circuit automatically deactivates after passage of a predetermined time interval after activation.

12. The apparatus according to claim 11, wherein the control circuit comprises a time delay member, in particular a flip-flop, which time delay member furnishes the contact of a control unit, in particular of a microprocessor, to a current or, respectively voltage source upon triggering with the switching pulse of the sensor for predetermined time period interval, thereby control unit is activated and is capable to induce the release of the flushing process.

13. An apparatus for automatic triggering of a flushing process after usage of a urinal or similar sanitary engineering installation, such as a toilet, wherein at least one target (1.4) is disposed in a water trap (siphon) (1.15) of the urinal exhibiting a feed-in inlet (1.1) and a discharge outlet (1.14), which target changes its position upon level changes (1.13, 1.14, 1.5, 2.1,2.2, 2.3) of the liquid contained in the siphon (1.15), and wherein the change in position is captured by a sensor (1.8,1.9), which sensor causes the generation of a switching pulse (1.10) then when the liquid level changes by a predetermined amount, and wherein the switching pulse triggers an electro-water valve or, respectively, a magnet controlled water valve, thereby the opening of the water valve and the initiation of the flushing process is caused, characterized in that a discharge barrier (1.6) is disposed in the discharge outlet (1.14) of the siphon (1.15), wherein the discharge barrier (1.6) is furnished with an opening (3.3), wherein the cross-section of this opening (3.3) is dimensioned such that only a volume stream smaller than the average urine volume per time unit is possible through this opening (3.3) and wherein the target (1.4) is disposed in the region of the discharge barrier (1.6);

wherein a further hollow body disposed in front of the barrier in the water trap is level adapted next to the water trap connected such that this connection allows to flow in fed-in liquid into the hollow body below the discharge barrier of the water trap, and wherein the hollow body is connected in the lower region by a discharge direction discharge outlet of the water trap;

wherein a float with a target, in particular a magnet, is movably disposed in the second hollow body and wherein a sensor, in particular a magnet switch is disposed spatially fixed, wherein the sensor causes the generation of a switching pulse upon approach of the target by floating of the float, which switching pulse triggers a flushing process.

14. The apparatus according to claim 13, wherein the opening (3.3) is disposed below the level of the discharge barrier (1.6) and wherein the opening (3.3) enables the discharge of the water to the level of the discharge outlet (1.14);

wherein the target is a float (1.4), wherein at least one magnet (1.8) is disposed at the float (1.4) as well as the sensor comprises a magnet contact (1.9), wherein the magnet contact (1.9) is closed upon approach of the magnet (1.8).

15. The apparatus according to claim 14, wherein the magnet contact (1.9) switches a current circuit upon closing by the magnet (1.8) after deflection of the float (1.4) from the standard level (1.5), wherein the current circuit activates an electronic control unit and automatic control unit for a predetermined time period, which electronic control and automatic control unit induces the flushing of the urinal according to a predetermined operating course plan.

16. The apparatus according to claim 13, wherein the sensor comprises a pair of electrodes which captures a change of the level of the liquid and/or the composition of the liquid by detection of a change in the conductivity.

17. The apparatus according to claim 13, wherein the sensor comprises a light barrier, which light barrier is capable to detect a change of the level of the liquid or wherein the sensor is a capacitive sensor or an inductive sensor for detection of the level of liquid.

18. The apparatus according to claim 13, wherein the sensor comprises a float, which float changes its position after feeding in of liquid and which float thereby triggers a mechanical/hydraulic actuated valve and control mechanism, which valve and control mechanism leads to a release of the flushing process.

19. The apparatus according to claim 13, wherein the switching pulse of the sensor is an electronic pulse, which electronic pulse activates a control circuit, wherein the control circuit generates a signal for triggering the flushing process and wherein the control circuit automatically deactivates after passage of a predetermined time interval after activation;

wherein the control circuit comprises a time delay member, in particular a flip-flop, which time delay member furnishes the contact of a control unit, in particular of a microprocessor, to a current or, respectively voltage source upon triggering with the switching pulse of the sensor for predetermined time period interval, thereby control unit is activated and is capable to induce the release of the flushing process.

20. An apparatus for automatic triggering of a flushing process after usage of a urinal or similar sanitary engineering installation, such as a toilet, wherein at least one target (1.4) is disposed in a water trap (siphon) (1.15) of the urinal exhibiting a feed-in inlet (1.1) and a discharge outlet (1.14), which target changes its position upon level changes (1.13, 1.14, 15, 2.1,2.2, 2.3) of the liquid contained in the siphon (1.15), and wherein the change in position is captured by a sensor (1.8,1.9), which sensor causes the generation of a switching pulse (1.10) then when the liquid level changes by a predetermined amount, and wherein the switching pulse triggers an electro-water valve or, respectively, a magnet controlled water valve, thereby the opening of the water valve and the initiation of the flushing process is caused, characterized in that a discharge barrier (1.6) is disposed in the discharge outlet (1.14) of the siphon (1.15), wherein the discharge barrier (1.6) is furnished with an opening (3.3), wherein the cross-section of this opening (3.3) is dimensioned such that only a volume stream smaller than the average urine volume per time unit is possible through this opening (3.3) and wherein the target (1.4) is disposed in the region of the discharge barrier (1.6);

wherein the opening (3.3) is disposed below the level of the discharge barrier (1.6) and wherein the opening (3.3) enables the discharge of the water to the level of the discharge outlet (1.14);

wherein the target is a float (1.4), wherein at least one magnet (1.8) is disposed at the float (1.4) as well as the sensor comprises a magnet contact (1.9), wherein the magnet contact (1.9) is closed upon approach of the magnet (1.8);

wherein the float (6.1,7.4) supports a hollow body (6.2, 7.5), wherein the hollow body exhibits a discharge opening (6.3) of a small cross-section, wherein the hollow body (6.2,7.5) is disposed such in the siphon, that the hollow body is filled with the fed-in urine, which causes a change in position of the float (6.1,7.4), whereby a switching pulse is triggered.

21. The apparatus according to claim 20, wherein a further hollow body disposed in front of the barrier in the water trap is level adapted next to the water trap connected such that this connection allows to flow in fed-in liquid into the hollow body below the discharge barrier of the water trap, and wherein the hollow body is connected in the lower region by a discharge direction discharge outlet of the water trap;

wherein a float with a target, in particular a magnet, is movably disposed in the second hollow body and wherein a sensor, in particular a magnet switch is disposed spatially fixed, wherein the sensor causes the generation of a switching pulse upon approach of the target by floating of the float, which switching pulse triggers a flushing process.

22. The apparatus according to claim 20, wherein the magnet contact (1.9) switches a current circuit upon closing by the magnet (1.8) after deflection of the float (1.4) from the standard level (1.5), wherein the current circuit activates an electronic control unit and automatic control unit for a predetermined time period, which electronic control and automatic control unit induces the flushing of the urinal according to a predetermined operating course plan.

23. The apparatus for automatic triggering of a flushing process according to claim 1 further comprising a lever rod construction connected to the target, wherein the sensor comprises a magnet attached to the to the target and magnet contacts disposed to be triggered by the magnet upon pivoting of the magnet past the magnetic contacts for triggering a switching process of an electrical contact, said switching process corresponding to two different levels of the target, and for generating a switching pulse to be passed through a conduit;

an electronic control circuit connected to the conduit such that the electronic control circuit performs a complete switching off of the electronics without quiescent current between flushings.

* * * * *